US008412482B2

(12) United States Patent
Robillard et al.

(10) Patent No.: US 8,412,482 B2
(45) Date of Patent: Apr. 2, 2013

(54) MULTI CHANNEL ELECTRONIC ACCELERATION SWITCH

(75) Inventors: David C. Robillard, Oro Valley, AZ (US); Gregory E. Longerich, Oro Valley, AZ (US)

(73) Assignee: Raytheon Company, Waltham, MA (US)

( * ) Notice: Subject to any disclaimer, the term of this patent is extended or adjusted under 35 U.S.C. 154(b) by 419 days.

(21) Appl. No.: 12/630,007

(22) Filed: Dec. 3, 2009

(65) Prior Publication Data

US 2011/0313715 A1 Dec. 22, 2011

(51) Int. Cl.
*G01P 15/00* (2006.01)
*G06F 15/00* (2006.01)

(52) U.S. Cl. ..... 702/141; 307/10.1; 345/157; 701/29; 701/46; 702/151

(58) Field of Classification Search ..... 702/34, 702/96, 99, 127, 141, 152, 182, 151; 701/29, 701/37, 45, 46; 307/10.1; 342/374; 180/174, 180/282; 345/157
See application file for complete search history.

(56) References Cited

U.S. PATENT DOCUMENTS

| | | | | |
|---|---|---|---|---|
| 5,874,941 | A * | 2/1999 | Yamada | 345/157 |
| 6,566,765 | B1 * | 5/2003 | Nitschke et al. | 307/10.1 |
| 6,765,312 | B1 * | 7/2004 | Urlass et al. | 307/10.1 |
| 6,813,584 | B2 * | 11/2004 | Zhou et al. | 702/151 |
| 2010/0191408 | A1 * | 7/2010 | Boylston et al. | 701/29 |
| 2010/0256872 | A1 * | 10/2010 | Le et al. | 701/46 |

FOREIGN PATENT DOCUMENTS

| | | | |
|---|---|---|---|
| DE | 19628222 | A1 | 1/1998 |
| DE | 19813921 | A1 | 9/1999 |
| DE | 19813943 | A1 | 9/1999 |
| DE | 199 55 721 | A1 | 5/2001 |
| EP | 0800254 | A2 | 10/1997 |
| GB | 2005887 | A | 4/1979 |

OTHER PUBLICATIONS

International Search Report and Written Opinion from corresponding International Application No. PCT/US10/41457, (year: 2010).

* cited by examiner

*Primary Examiner* — John H Le
(74) *Attorney, Agent, or Firm* — Renner, Otto, Boisselle & Sklar, LLP

(57) ABSTRACT

An electronic acceleration switch, such as for arming and firing a squib, for instance used in arming a warhead, safe missile air, ground and sea launch separation arming, includes multiple redundancies to provide a fail-safe system that does not have a single-point failure. The switch includes different channels, each of which includes a power subsystem, multiple accelerometers, a pair of controllers, and a switching circuit. The power subsystems of the two channels provide power to multiple accelerometers of each channel. The accelerometers of each channel may include a mix of digital and analog accelerometers. The acceleration sensors can be either one-axis or three-axis sensors. The accelerometers are connected to the controllers of both channels. The controllers provide redundancy for each channel. In addition, the controllers include voting logic that receives inputs from the accelerometers, and determines whether to send arm and enable signals to the multiple squib drivers.

18 Claims, 5 Drawing Sheets

MULTI CHANNEL ELECTRONIC ACCELERATION SWITCH

GOVERNMENT RIGHT STATEMENT

This invention was made with the United States Government support under Contract Number N00024-03-C-6111 awarded by the Department of the Navy. The United States Government has certain rights to this invention.

BACKGROUND OF THE INVENTION

1. Technical Field of the Invention

This disclosure relates generally to acceleration monitoring switches, usable for such purposes as arming, firing warheads, and stage separation of missiles.

2. Description of the Related Art

Acceleration monitors are used to recognize variations in speed. For example, when a vehicle is driving according to the speed limit, a sudden collision may bring the vehicle to a complete stop in just fractions of a seconds. An acceleration monitor recognizes this sudden change and can initiate the response of airbag detonation.

An acceleration monitor commonly comprises a mechanical lever of a certain weight that will deflect in response to an applied force.

Mechanical acceleration monitors and switching devices may be large, heavy, and difficult to troubleshoot and test. These devices typically employ mechanical contacts that can suffer from poor electrical properties such as chatter, signal integrity and reliability.

SUMMARY OF THE INVENTION

An electronic module is provided to monitor in acceleration and time for determining distance traveled. Electronic acceleration monitors have been avoided in vehicles for safety critical applications (including missiles, rockets, etc.) due to the need for high reliability and redundancy.

According to an aspect of the invention, a redundancy scheme may be incorporated within an electronic acceleration monitor to avoid a single point failure. This may be accomplished by including multiple power sources, sensors, channels, etc.

According to another aspect of the invention, when poor data is received due to a failure of an accelerometer or other part, a voting scheme may be applied in an acceleration switch to allow only accurate data through to signal a response (i.e. timer, squib, etc.). This voting logic allows reconfiguration for any single point failure mode providing increased mission success within the acceleration-monitoring system.

According to yet another aspect of the invention, an electronic acceleration switch includes redundant controllers and multiple analog and digital accelerometers.

According to still another aspect of the invention, an electronic acceleration switch includes multiple channels, each of which includes independent power subsystem, multiple accelerometers, multiple controllers, and a switching circuit.

According to yet another aspect of the invention, an electronic acceleration switch includes: a first power subsystem; a second power subsystem; multiple first channel accelerometers; multiple second channel accelerometers; and a pair of controllers. The first channel accelerometers are powered by the first power subsystem, and the second channel accelerometers are powered by the second power subsystem. Both the first channel accelerometers and the second accelerometers provide outputs to both of the controllers.

According to a further aspect of the invention, a method of operating an electronic acceleration switch includes the steps of: sending output from accelerometers of a pair of channels to at least one controller of each of the channels; and using voting logic in each of the controllers to make independent determinations of whether acceleration exceeds a predetermined threshold.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF THE DRAWINGS

The annexed drawings, which are not necessarily to scale, show various aspects of the invention.

DETAILED DESCRIPTION

An electronic acceleration switch, such as for arming and firing a squib, for instance used in a warhead, includes multiple redundancies to provide a fail-safe system that does not have a single-point failure. The switch includes different channels, each of which includes a power subsystem, multiple accelerometers, a pair of controllers, and a switching circuit. The power subsystems of the two channels may be powered by either of a pair of power systems, which for example may be batteries. Either of the power systems may provide enough to power both of the power subsystems, so as to be able to fully power both channels of the switch. The power subsystems of the two channels provide power to multiple accelerometers of each channel. The accelerometers of each channel may include a mix of digital and analog accelerometers. The accelerometers are connected to the controllers of both channels. Multiple controllers provide redundancy within each channel. In addition, the controllers include voting logic that receives inputs from the accelerometers, and determines whether to send arm and enable signals to the switched outputs which provides power to multiple squib drivers.

Figure 1:
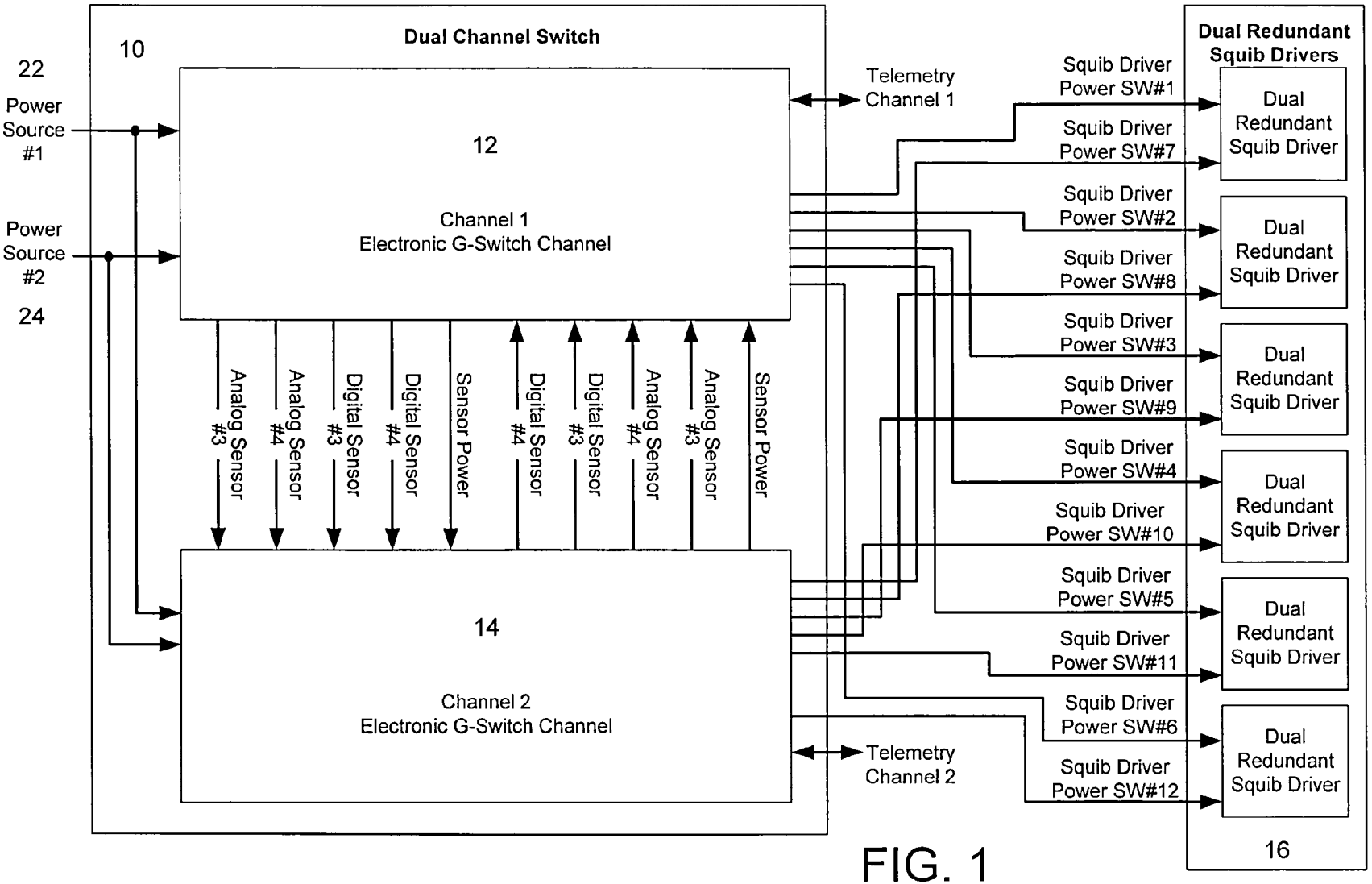
FIG. 1 is a block diagram of an electronic acceleration switch in accordance with an embodiment of the invention.

Referring initially to FIG. 1, an electronic acceleration switch 10 has a pair of channels 12 and 14 that are used to provide power to multiple external subsystems which provide signals to detonate a squib driver 16. In essence, the switch 10 is used to determine when activation power should be sent to external subsystems which control when and under what conditions the squib driver 16 detonates. The switch 10 and the squib driver 16 may be parts of a missile, with the squib being used for example to detonate a warhead of the missile. It will be appreciated that the switch 10 may be used to detonate the squib driver 16 in other devices and/or circumstances, for example being part of a system for inflating an airbag on a vehicle.

A pair of power sources 22 and 24 provide power to the channels 12 and 14. The power sources 22 and 24 may be any of a variety of suitable power sources, for example being batteries. The power sources 22 and 24 are each coupled to both of the channels 12 and 14, and may be capable of each individually powering all of the components of both channels 12 and 14. Thus the power sources 22 and 24 may provide redundancy to permit full operation of the switch 10 even when one of the power sources 12 and 14 is inoperative.

Figure 2:
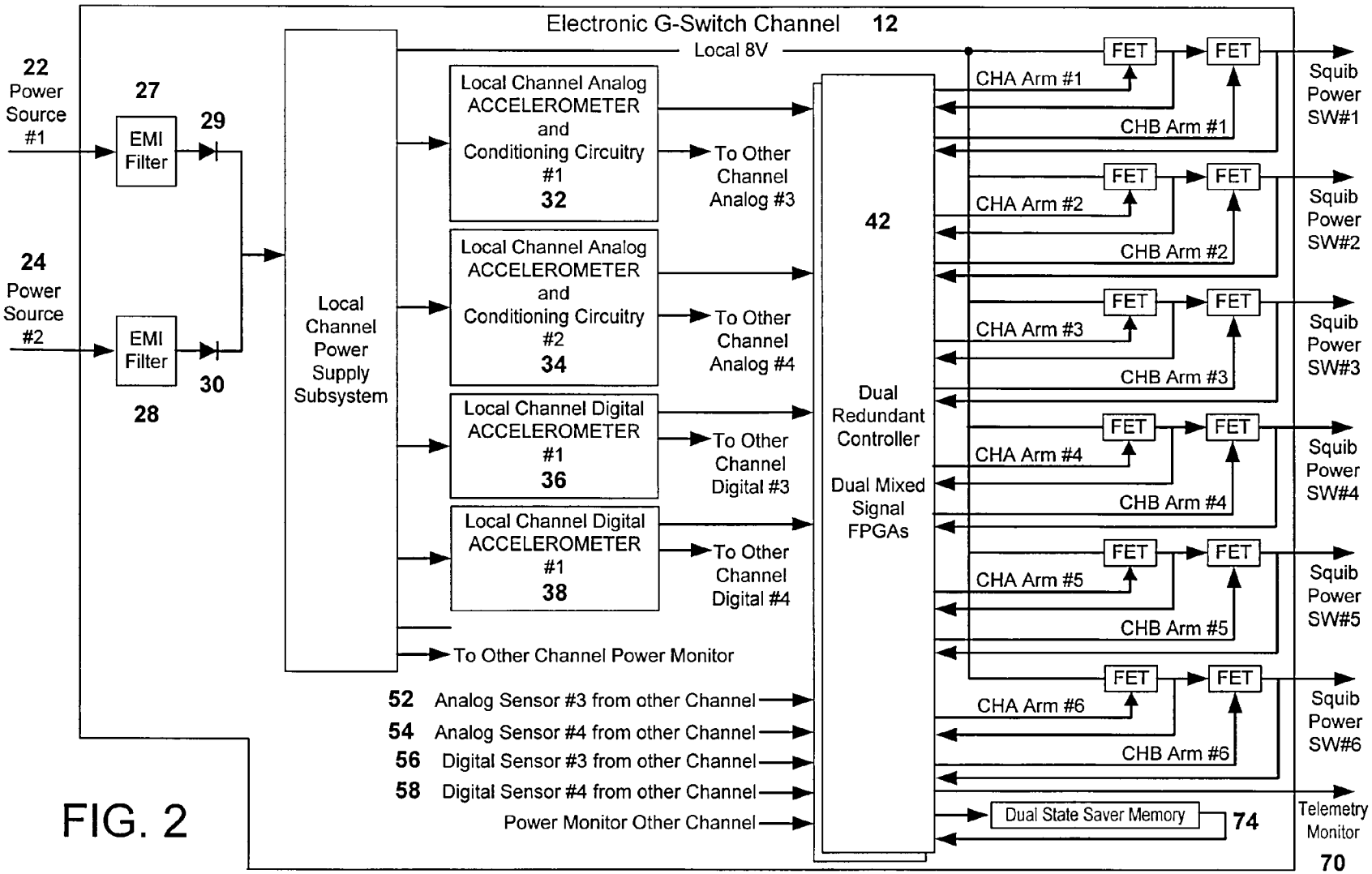
FIG. 2 is a block diagram of one channel of the electronic acceleration switch of FIG. 1.

With reference now to FIG. 2, some of the components of the first channel 12 are illustrated. It will be appreciated that the second channel 14 (FIG. 1) may have similar components. The first channel 12 includes a power supply subsystem 26 that is operatively coupled to both of the power sources 22 and 24. Filters 27 and 28, and diodes 29 and 30, are located between the power supply subsystem 26 and the power sources 22 and 24. The filters 27 and 28 filter out electromagnetic interference from the power received, and the diodes 29 and 30 allow power to flow in only one direction, from the power sources 22 and 24 to the power supply subsystem 26.

The power supply system 26 supplies power to a series of accelerometers 32-38. The accelerometers include a pair of analog accelerometers 32 and 34, with correcting circuitry, and a pair of digital accelerometers 36 and 38. The number of accelerometers 32-38 may be greater than or less than what is shown in FIG. 2. However it is advantageous to have the accelerometers 32-38 include both analog and digital accelerometers, and of further advantage for there to be both multiple analog accelerometers and multiple digital accelerometers. By having both analog and digital accelerometers, and multiple accelerometers of both types, another measure of redundancy is provided in the switch 10. Different types of accelerometers respond to different sorts of stimuli, encounter different sorts of errors, and fail to perform properly in different ways. In other words, the different types of accelerometers have different failure modes. Having different sorts of accelerometers, and multiple accelerometers of each type, aids in preventing inadvertent or incorrect triggering of the squib driver 16 by the switch 10.

The accelerometers 32-38 are each operatively coupled to both of a pair of redundant controllers 42 and 44. The controllers 42 and 44 receive signals from the accelerometers 32-38. The controllers 42 and 44 also receive signals 52-58 from the accelerometers of the other channel, the second channel 14 (FIG. 1). Similarly, the accelerometers 32-38 have respective outputs to the redundant controllers of the second channel 14. The controllers 42 and 44 process the signals from the accelerometers of both of the channels 12 and 14, and make a determination when to send arm and enable signals to control the switch power to the external squib drivers 16 (FIG. 1). Each controller's arm signal allows activation of its serial switch. Both serial switches armed by separate controllers 42 and 44 provide power to the external squib driver subsystem.

Two controllers 42 and 44 are used to provide redundancy in the operation of the switch 10. The controllers 42 and 44 may be separate field programmable gate arrays (FPGAs). The controllers 42 and 44 may have different logic configurations implementing the same algorithms, reducing the likelihood of a common mode failure mode of both of the controllers 42 and 44.

Output signals from the controllers 42 and 44 are sent to switching circuitry 64 before being sent to the squib drivers 16 (FIG. 2). The switching circuitry 64 includes respective pairs of field effect transistors (FETs) corresponding to each squib power signal output from the redundant controllers 42 and 44. FET pairs, such as the FETs 66 and 68, are coupled in series, one being controlled by the controller 42 and second one controlled by the controller 44. The FET pairs provide an additional degree from false activation, requiring a signal or output from each of the controllers 42 and 44 in order to provide squib driver power to be sent to the corresponding squib driver 16 (FIG. 1).

The controllers 42 and 44 each provide an additional output 70 for the telemetry monitor and health check for the respective controller. The telemetry monitor (not shown) is external to the system.

Each channel's controller interfaces with a state memory 74. In the event of a power interrupt, each controller would wake up to the last the last state obtained and continue operation at the point where it left off. The memory 74 may be a solid state non-volatile memory.

The accelerometers 32-38 may be any of a variety of suitable accelerometers or acceleration sensors including micro electro mechanical (MEMS) accelerators. It is advantageous for the accelerometers 32-38 to be dissimilar, to eliminate possible common failure modes. In addition, the dissimilarity may include a dissimilar interface (i.e., digital and analog), to eliminate common failures within the monitoring controller subsystems. Depending upon the switching application, the acceleration sensors can be either a single-axis or a three-axis sensor.

Figure 3:
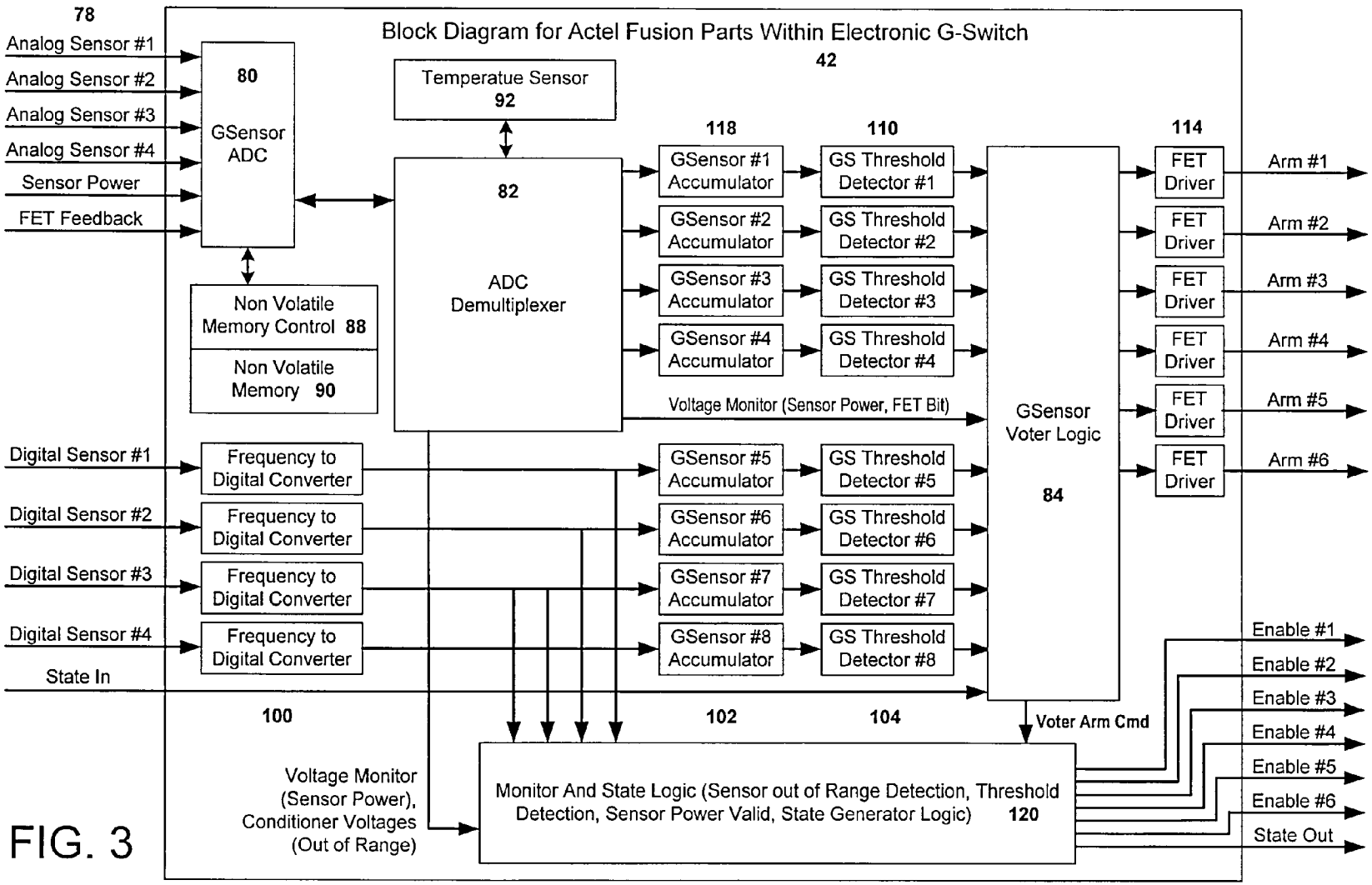
FIG. 3 is a block diagram of a controller of the acceleration switch channel of FIG. 2.

Turning now to FIG. 3, details are shown of one of the controller 42. It will be appreciated that dissimilar structures and/or functionality may be present in the controller 44 (FIG. 2), as well as in the controllers of the second channel 14 (FIG. 1). Analog accelerometer inputs 78 (from the accelerometers of both channels) are passed through an analog-to-digital converter ("ADC") 80 and a demultiplexer 82. In addition the ADC 80 receives a sense signal from sensor power, and a voltage sense inputs from FET outputs, which are used for built in test and forwarded through the demultiplexer 82 to acceleration sensor voting logic 84.

A non-volatile memory 90 and a non-volatile memory controller 88 control the analog-to-digital converter 80 subsystem states. A temperature sensor 92 is provided to the demultiplexer 82 and allows temperature compensation for the external accelerator devices.

Digital accelerometer inputs 98 (from the accelerometers of both channels) pass through respective frequency-to-digital converters 100. Outputs from the converters 100 are directed to respective accumulators 102, which are monitored by respective threshold detectors (detection logic) 104. The threshold detectors 104 are used to determine whether the accumulated accelerations received by the accumulators 102 exceed a predetermined threshold. Similarly, the outputs from the demutliplexer 82 corresponding to the analog accelerator inputs 78, pass through respective accumulators 108, which are monitored by threshold detectors 110.

The outputs from the threshold detectors 104 and 110 are forwarded to the sensor voting logic 84. The voting logic 84 makes a determination, based on the inputs from the threshold detectors 104 and 110, whether to send signals to arm and/or enable the power to the squib drivers 16 (FIG. 1). The voting logic 84 may be configured to only send arm and/or enable signals when certain criteria on threshold detection of the accelerometers are met. For example, the voting logic 84 may be configured to send arm and/or enable signals only when a certain predetermined number of the accelerometers have passed predetermined acceleration thresholds. This prevents arming or filing of the squib driver 16 based on the output of only a single accelerometer and requires threshold detection by multiple accelerator types to prevent common mode failures. Sending power to the squib driver 16 based on output of a single accelerometer would raise the possibility of a single-point failure in the switch 10 (FIG. 1), a situation where the malfunction of a single part could erroneously produce arm and/or enable signals to the FETs which would provide the power to the external squib drivers 16. According to a specific embodiment, the voting logic 84 may be configured to allow sending of arm and/or enable signals when at least three accelerometers have had their predetermined thresholds exceeded.

Another possibility is that the voting logic 84 may be configured to send arm and/or enable signals only when at least one accelerometer of each type (analog and digital) exceeds its predetermined acceleration threshold. Such a criterion prevents arming or detonating the squib driver 16 (FIG. 1) on the basis of only one type of accelerometer. Since multiple accelerometers of the same type may experience similar failure modes, allowing arm and/or enable signals to be sent on the basis of responses from multiple accelerometers of the same type could cause firing of the squib on the basis of a condition that would produce erroneous results in a single type of accelerometer. This would not be a single-point failure condition, strictly speaking, but would be a situation that could be caused by failure of similar parts due to a single situation.

It will be appreciated that the voting logic 84 may combine the example conditions discussed in two previous paragraphs. The voting logic 84 might thus require a predetermined number of accelerometers (for example, three or more accelerometers) to exceed their threshold conditions, while also requiring at least one analog accelerometer and at least one digital accelerometers to be among those meeting their acceleration thresholds.

Arm signals are sent from the voting logic 84 through a series of FET drivers 114, with respective of the FET drivers 114 corresponding to each arm signal. From the FET drivers 114 the arm signals are sent out of the controller 42 and to the switching circuitry 64 (FIG. 2). The FET drivers 114 are used to control the FETs 66 and 68.

An arm signal is also sent from the voting logic 84 to monitor and state logic 120. The monitor and state logic 120 may be used to control timing of the sending of enable signals to detonate the squib driver 16 (FIG. 1). The state logic 120 may be configured to send the enable signal a predetermined time after the arm signal indication is received from the voting logic 84. This allows precise timing of the sending of the enable signals, to allow precise detonation of a warhead (for example) at a predetermined time from launch or another acceleration event.

The monitor and state logic 120 also monitors various parts of the controller 42, and various inputs received by the controller 42. For example the monitor and state logic 120 may monitor the acceleration sensors for out-of-range detection and threshold detection. The monitor and state logic 120 may also monitor power supplied to the accelerometers (sensors) and to the controller 42.

It will be appreciated that the various components described above as part of the controller 42 may be realized in software and/or hardware. The controller 42 may be or include any of a variety of integrated circuit controllers. One example is an Actel Fusion programmable controller.

The temperature sensor 92 may be used to calibrate the sensors (accelerometers), shifting the threshold for the accelerometers, as a function of temperature. The thresholds applied by the threshold detectors 104 and 110, and/or the voting logic 84, may be changed based on a function of temperature, for example using a look-up table. Calibration of the sensors would allow accuracy over temperature beyond their initial accuracy, for those applications requiring extreme precision of the sensor data.

Figure 4:
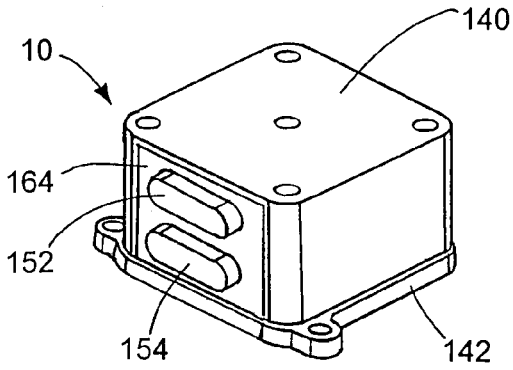
FIG. 4 is an oblique view of an electronic acceleration switch in accordance with an embodiment of the invention.
Figure 5:
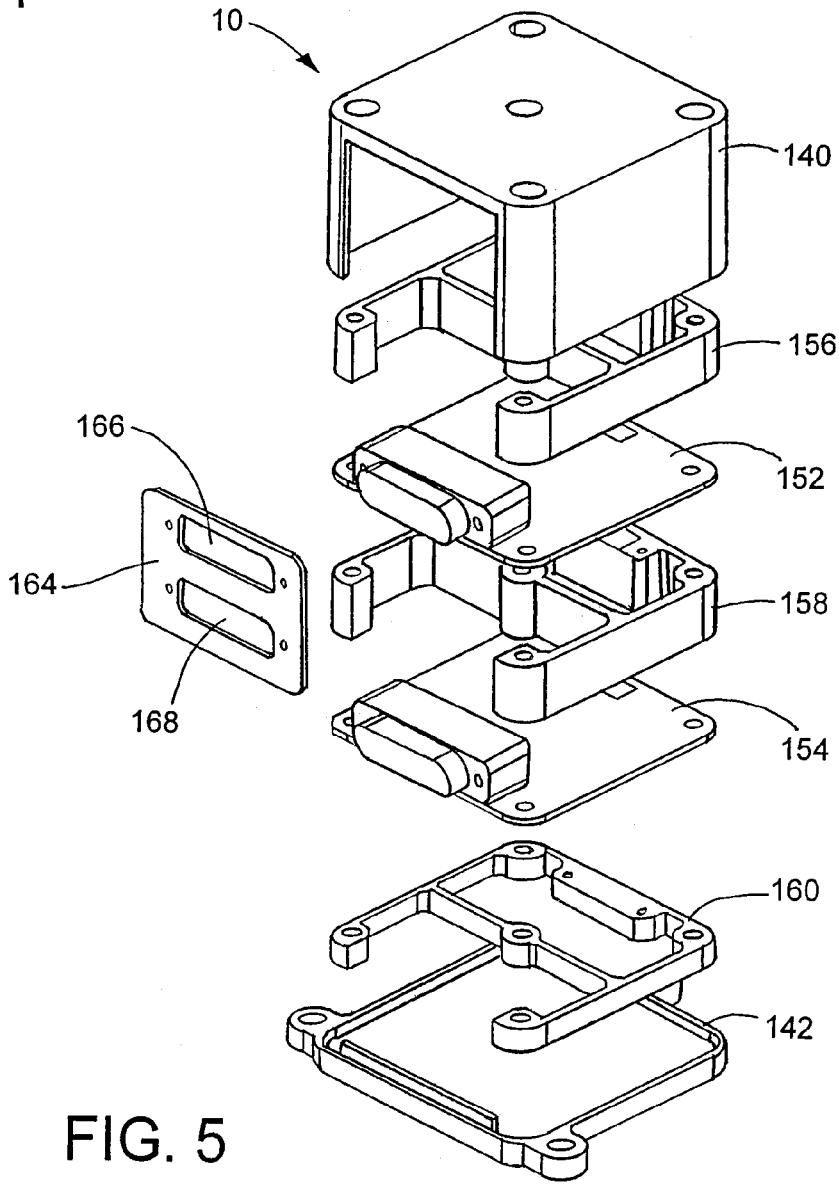
FIG. 5 is an exploded view of the switch of FIG. 4.

FIGS. 4 and 5 show one possible implementation of the electronic acceleration switch 10. The operative parts of the switch 10 are enclosed within a case 140. The case 140 may be made of aluminum, and may be coupled to an aluminum base 142. The case 140 encloses a pair of electronics boards (circuit card arrays) 152 and 154. The board 152 includes the components of the first channel 12 (FIG. 1), and the board 154 includes the components of the second channel 14 (FIG. 1). Three spacers 156, 158, and 160 separate the boards 152 and 154 from one another, to separate the board 152 from the top of the case 140, and to separate the board 154 from the base 142. The spacers 156-160 may be made of a thermoplastic material, such as a material sold under the trademark DELRIN. The spacers 156-160 keep the boards 152 and 154 properly spaced with regard to the case 140. The middle spacer 158 may be sized such that the boards 152 and 154 may be electrically coupled together without use of cables. A cover 164 may the front of the case 140, with openings 166 and 168 for connectors to couple to the boards 152 and 154 to other devices, such as the squib driver 16 (FIG. 1).

Figure 6:
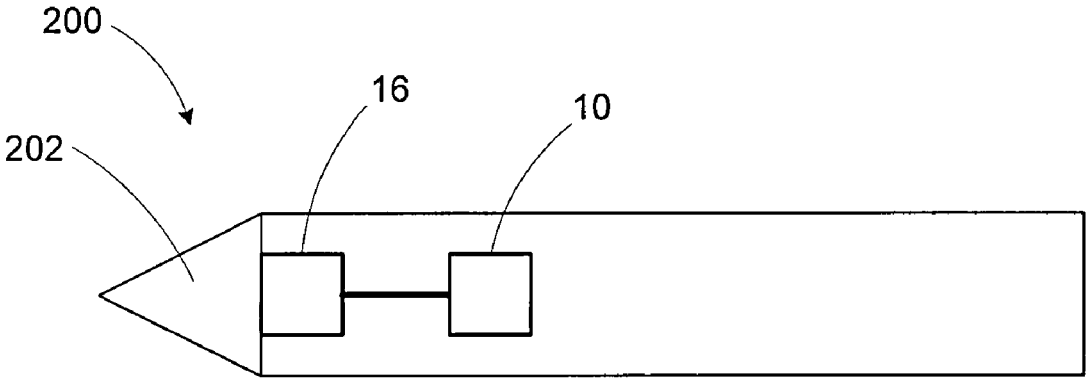
FIG. 6 is a schematic diagram of the switch of FIG. 1 as part of a missile.
Figure 7:
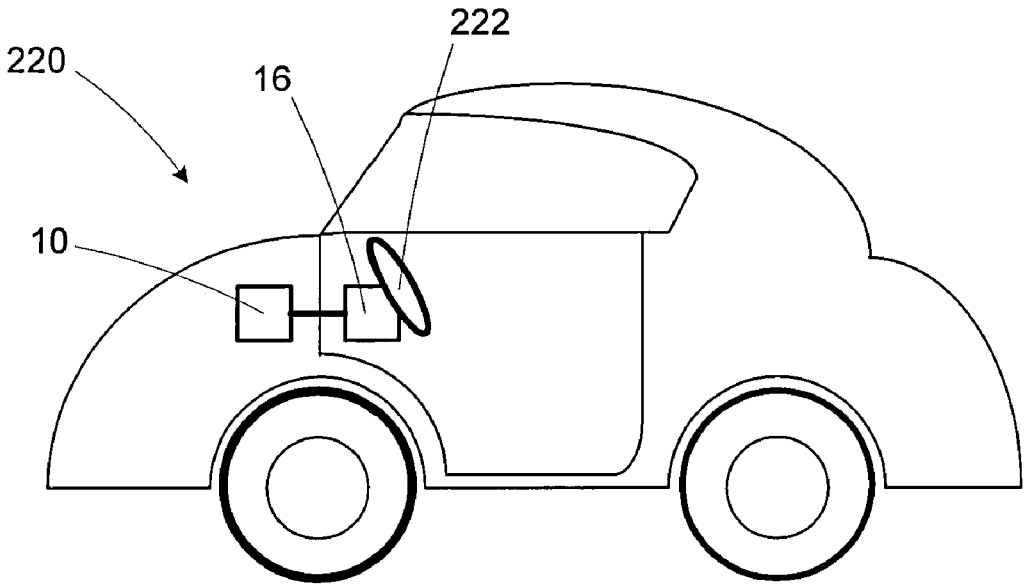
FIG. 7 is a schematic diagram of the switch of FIG. 1 as part of a vehicle.

FIG. 6 shows the switch 10 and the squib driver 16 as parts of a missile 200, with the squib driver 16 used to detonate a warhead 202 of the missile 200. FIG. 7 shows the switch 10 and the squib driver 16 as parts of a vehicle 220, such as a car, truck, or bus, with the squib driver 16 used to initiate inflation of an air bag 222.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. An electronic acceleration switch comprising:

a first power subsystem;

a second power subsystem;

multiple first channel accelerometers;

multiple second channel accelerometers; and a pair of controllers;

wherein the first channel accelerometers are powered by the first power subsystem, and the second channel accelerometers are powered by the second power subsystem;

wherein both the first channel accelerometers and the second accelerometers provide outputs to both of the controllers; and wherein the first channel accelerometers and the second channel accelerometers both include both analog accelerometers and digital accelerometers.

2. The electronic acceleration switch of claim 1, wherein the switch further comprises a pair of power systems, each coupled to both of the power subsystems, and each able to provide power to both of the power subsystems so as to power the first channel accelerometers, the second channel accelerometers, and the controllers.

3. The electronic acceleration switch of claim 1, wherein the accelerometers are micro-electro-mechanical system (MEMS) accelerometers.

4. The electronic acceleration switch of claim 1, wherein the switch further comprises a pair of output switching circuits coupled to the controllers so as to send an output arm signal to an external squib driver only when corresponding input arm signals are received from both of the controllers.

5. The electronic acceleration switch of claim 4, wherein the switch sends an output enable signal to the external squib driver only when corresponding input enable signals are received from both of the controllers.

6. The electronic acceleration switch of claim 1, wherein the controllers are embodied in respective first and second integrated circuits.

7. The electronic acceleration switch of claim 6, wherein the first integrated circuit, the first power subassembly, and the first channel accelerometers are parts of a first circuit card; and wherein the second integrated circuit, the second power subassembly, and the second channel accelerometers are parts of a second circuit card.

8. The electronic acceleration switch of claim 1, wherein the controllers each include:

voting logic; and respective accumulators and respective threshold detectors operatively connected to respective of the accelerometers;

wherein the accumulators sum signals from the accelerometers; and wherein the threshold detectors each send a signal to the voting logic when a predetermined threshold is exceeded.

9. The electronic acceleration switch of claim 8, wherein the voting logic outputs an arm command only when the predetermined threshold is exceeded for multiple accelerometers.

10. The electronic acceleration switch of claim 8, wherein the voting logic outputs an arm command only when the predetermined threshold is exceeded for at least three of the accelerometers.

11. The electronic acceleration switch of claim 8, wherein the voting logic outputs the arm command only when the predetermined threshold is exceeded both for at least one of the analog accelerometers and for at least one of the digital accelerometers.

12. The electronic acceleration switch of any claim 1, wherein the first power subsystem, the first channel accelerometers, and the controllers are parts of a first channel of the electronic acceleration switch; and wherein the second power subsystem, the second channel accelerometers, and an additional pair of controls are parts of a channel of the electronic acceleration switch.

13. The electronic acceleration switch of claim 12, wherein the first channel is on a first circuit card; and wherein the second channel is a second circuit card.

14. The electronic acceleration switch of claim 13, wherein the circuit cards are electrically coupled together directly, without use of an intervening cable.

15. The electronic acceleration switch of claim 14, further comprising a spacer between the circuit cards;

wherein the spacer maintains a predetermined distance between the circuit cards.

16. The electronic acceleration switch of claim 15, further comprising a case enclosing the circuit cards and the spacer.

17. The electronic acceleration switch of claim 1, wherein at least one of the controllers includes a temperature sensor operatively coupled to other parts of the at least one of the controllers, to allow temperature compensation of acceleration thresholds.

18. The electronic acceleration switch of claim 1, wherein each controller of the pair of controllers has a logic configuration for implementing an algorithm; and wherein each of the controllers have different logic configurations for implementing the algorithm.

* * * * *